US007733212B2

(12) United States Patent
Fricke et al.

(10) Patent No.: US 7,733,212 B2
(45) Date of Patent: Jun. 8, 2010

(54) RESISTOR

(75) Inventors: Peter James Fricke, Corvallis, OR (US); Alan R. Arthur, Salem, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 635 days.

(21) Appl. No.: 11/740,587

(22) Filed: Apr. 26, 2007

(65) Prior Publication Data

US 2008/0266048 A1 Oct. 30, 2008

(51) Int. Cl.
*H01C 1/14* (2006.01)

(52) U.S. Cl. ..... 338/324; 338/308; 338/295; 338/314; 257/536; 257/343

(58) Field of Classification Search ..... 338/307, 338/309, 314, 25, 28, 226, 295, 324; 257/335, 257/340, 343, 379, 409
See application file for complete search history.

(56) References Cited

U.S. PATENT DOCUMENTS 3,621,441 A 11/1971 Hudnall et al.
4,050,052 A * 9/1977 Reichelt et al. ..... 338/308
4,103,275 A * 7/1978 Diehl et al. ..... 338/25
4,282,507 A * 8/1981 Tindall et al. ..... 338/25
4,904,951 A 2/1990 Molina et al.
5,034,736 A 7/1991 Bennett et al.
5,059,978 A 10/1991 Valdenaire
5,148,143 A 9/1992 Greenstein
5,206,623 A 4/1993 Rochette et al.
5,504,471 A 4/1996 Lund
5,508,724 A 4/1996 Boyd et al.
5,521,576 A 5/1996 Collins
5,935,642 A 8/1999 Suga
6,344,952 B1 2/2002 Biskeborn et al.
6,850,212 B1 2/2005 Aitken et al.
7,119,415 B2 10/2006 Norstrom et al.
2004/0227614 A1 11/2004 Kwok et al.
2006/0087399 A1 4/2006 Barge et al.

* cited by examiner

*Primary Examiner*—Kyung Lee

(57) ABSTRACT

Embodiments of a resistor are disclosed.

21 Claims, 5 Drawing Sheets

RESISTOR

BACKGROUND

Some research groups are currently seeking to commercialize bi-stable displays in a variety of paper-replacement applications ("e-Print"). Paper-replacement applications may desire to incorporate less expensive materials and processes but such display applications generally use low power designs to be commercially successful. Display circuitry for commercial applications can often be designed and processed within tolerances centered around low current and voltage thresholds used to activate pixel elements. Controlling resistance values in such circuits is one way to achieve the design tolerances and robust electrical designs necessary for commercial mass production in paper replacement applications.

As a result, it is desirable to reduce the cost of the processing steps and materials in order to keep the cost of the overall paper-replacement applications down. Simply reducing the display layers or eliminating processing steps may reduce costs but may also reduce the ability to control the electrical tolerances needed for robust designs. Providing processes and display structures that meet the criteria of both low cost commercial production and robust electrical design for commercial mass production can be a difficult balancing act.

DETAILED DESCRIPTION

Figure 1:
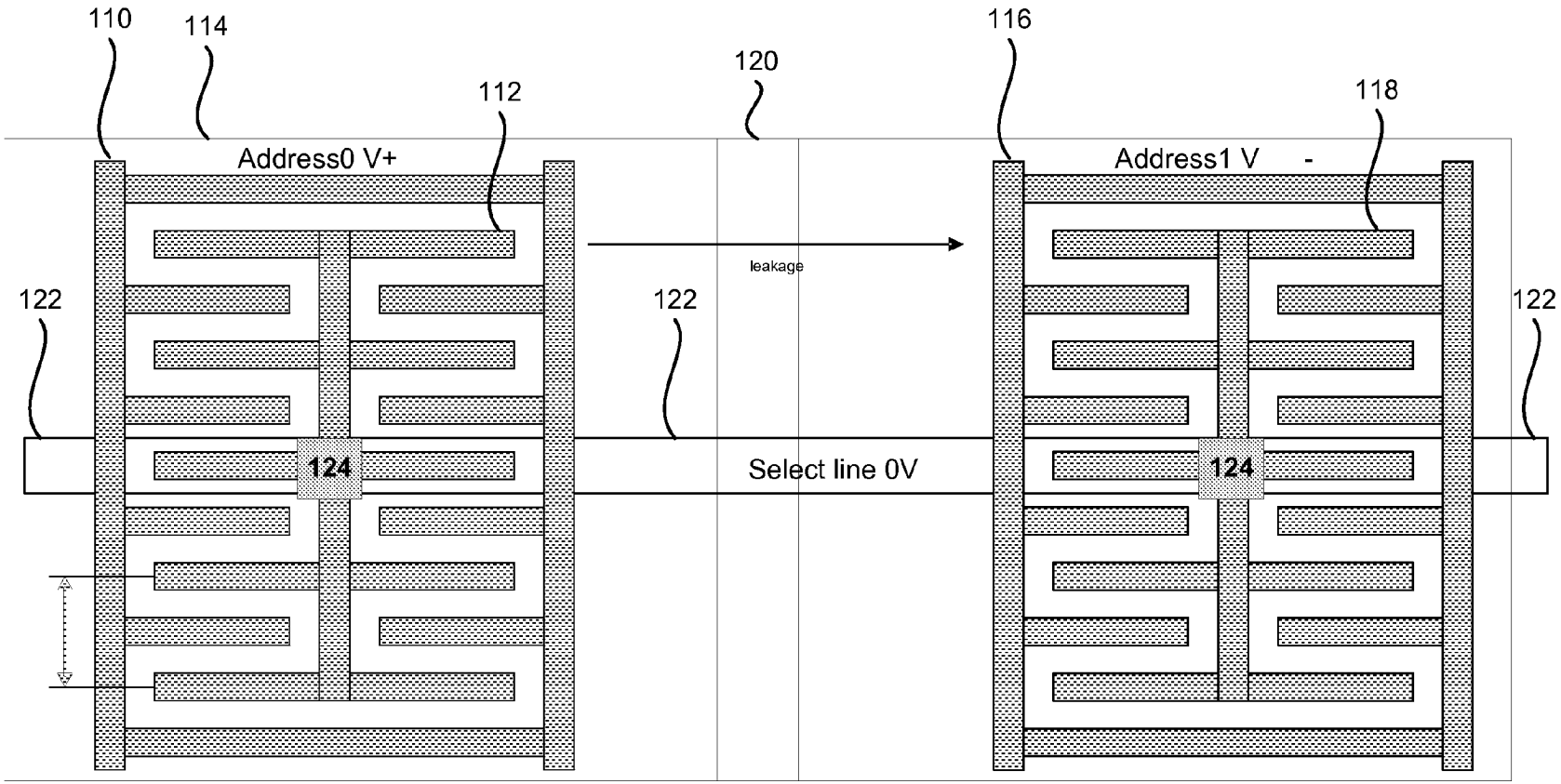
FIG. 1 is a top view of two address line pairs and a single select line comprising two codeword bulk resistors in accordance with an embodiment.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

There exists a gap between paper and digital displays. In some applications currently served by paper printouts, digital updating would be very useful. However current digital displays are too expensive, too power hungry, too heavy, and provide more capability than is needed for many applications. For example, consider in-store advertising. Shelf edge labels and signs are printed monthly, weekly, or even daily. If these signs could be updated digitally, a store is likely to save labor, paper, and ink. Current display technologies such as LCD and plasma are being repurposed as signs in stores, but they are expensive, heavy, and need to be plugged in. In addition, their resolution is often much lower than you would find on a similarly-sized paper poster. Bi-stable display technologies on plastic substrates offer lower power, light weight, lower cost, and higher resolution. In order to deliver on the promise of lower cost, the electronics and processing cost are desired to be reduced for the display.

Displays developed by the corporation E-ink are well known, using an electrophoretic light valve to create the optical effect. These displays are bistable, however, and may exhibit bistable voltage thresholds. This necessitates the use of an active matrix backplane, requiring a transistor at every pixel in the display. In addition to expensive electronics, the E-ink light valve is not very efficient, offering a contrast less than 10 and little possibility for good quality reflective color.

SiPix is another company that has developed electrophoretic displays with similar properties to the displays developed by E-ink. Also the companies ZBD and Nemoptic have focused on LC light valves which are more similar to the PABN light valves currently under development. Both technologies can be passively addressed, however these technologies do not appear to be targeting larger sized or very high resolution displays where demultiplexing offers a significant cost advantage. In addition these technologies are primarily being produced on glass substrates.

Several technologies for paper-like displays are currently in the market or under development at several corporations. Two promising bi-stable pixel technologies are Post Aligned Bistable Nematic (PABN) and Electrophoretically Controlled Nematic (EPCN). The characteristics of the liquid crystal (LC) provide for a voltage threshold to enable passive addressing. In addition to eliminating the need for active devices within the pixels, passive addressing utilizes demultiplexing to reduce the cost of the display electronics by reducing the number of drivers. While eliminating the need for active devices within the pixels, passive addressing utilizes demultiplexing to reduce the cost of the display electronics by reducing the number of display driver lines.

An embodiment that uses passive circuitry can build displays on flexible substrates including plastic substrates using embossing for patterning and plating to build up the necessary metal traces. Resistors for codeword demultiplexing are important to the development of electrophoretic displays because of the reduced cost they provide and because the resistor structures simplify manufacturing. Competitive approaches have been taken to demultiplexing. A 'permuted' resistor approach is one example where a variety of voltages applied across voltage divider circuits of equal resistances in series allows unambiguous addressing of liquid-crystal elements. While this approach significantly reduces the number of driver lines, the codeword method reduces them even more dramatically, especially as the number of lines increases.

Codeword demultiplexing, in accordance with one embodiment, can be achieved by plating contacts into multiple serpentine bulk resistor shapes in parallel. Codeword demultiplexing therefore has two degrees of freedom in addressing a unique pixel. The first degree of freedom is in allowing the application of a variety of voltages from disparate addressing signals across voltage divider circuits to a common select line. The second degree of freedom is in allowing a variety of resistances in the voltage divider circuits through a variety of discrete parallel bulk resistor combinations. Applying a variety of voltages across a variety of parallel resistors produces a greater number of unambiguous addresses. The higher number of voltage divisions increases the number of possible row and column combinations without increasing the number of address lines needed to select a unique pixel. For example, nearly 11,000 lines on a display can be driven with only 150 address lines using the 2:1 codeword architecture. Other passive demultiplexing methods are not believed to be as effective as codeword demultiplexing for reducing the number of drivers for a display.

In accordance with an embodiment, a bulk resistor film comprises a first set of patterned conductor protrusions, which are disposed adjacent to the bulk resistor film, and a second set of patterned conductor protrusions disposed adjacent the bulk resistor film. The second set of conductor protrusions is interleaved with the first set of conductor protrusions to provide a plurality of resistive paths to the first set of patterned conductor protrusions through the bulk resistor film. In other words, the multiple patterned protrusions provide contiguous parallel resistive paths for current from the first set of patterned protrusions to the second set of patterned protrusions. The parallel paths as a group present less resistance to the current from the first set of protrusions to the second set of protrusions. The first set of patterned metal lines provide a first common node for current flowing from the parallel resistances to converge at the second common node provided by the second set of metal lines. Therefore there is no need for a pattern in the bulk resistive layer since it is the metal lines which provide the collector nodes for the current flowing through the parallel resistances in the bulk resistor.

FIG. 1 is a top view of two address lines and a single select line comprising two codeword bulk resistors in accordance with an embodiment of the present invention. The patterned conductor protrusions of the first address line 110 may enclose and/or interleave with the conductor protrusions 112 to define a first serpentine resistor shape using the bulk resistor film 114. The patterned conductor protrusions of the second address line 116 interleave with the conductor protrusions 118 to define a second serpentine resistor adjacent the bulk resistor film 114. The bulk resistor film 114 covers the area defined by the first address line 110 and the second address line 116 and may be disconnected by laser or deactivated between the first address line 110 and the second address line 116 by defining a narrow longitudinal strip 120. The enclosed conductor protrusions are connected to the select line 122 through vias 124.

Figure 2:
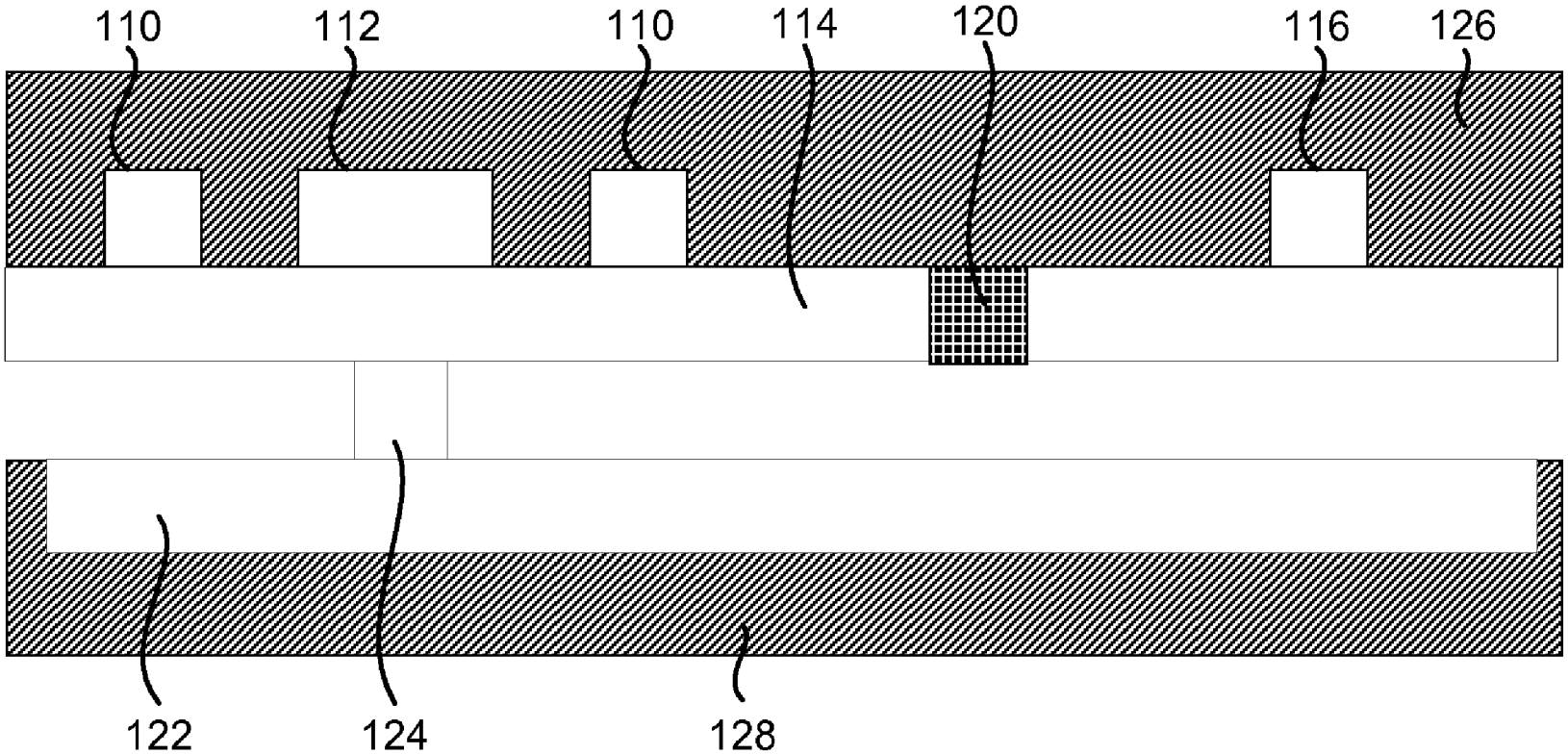
FIG. 2 is a cross-sectional schematic view of a single codeword bulk resistor in accordance with an embodiment of the present invention.

FIG. 2 is a cross-sectional schematic view of a single codeword bulk resistor in accordance with an embodiment of the present invention. The first address line 110 provides electrical communication with the conductive trace 112 through a plurality of contiguous resistive paths in the bulk resistor film 114. The embossing resin 126 prevents leakage current between the address line 110 and the conductive trace 112. Leakage current from the second address line 116 that reaches the via 124 can be reduced by the bulk resistor disconnect or deactivation strip 120. The via 124 makes electrical contact between the conductive trace 112 and the select line 122 embedded in resin 128.

Resistance can be further adjusted by varying the space between the first set of patterned conductor protrusions and the second set of patterned conductor protrusions which form a serpentine-like shape disposed adjacent the bulk resistor film. The serpentine-like shape turns a length of patterned conductor protrusions into a geometry that achieves a resistance equivalent to that of a longer straight length of patterned conductor protrusions. Having a wider but shorter aspect ratio, the serpentine-like shape is valuable for the electrically controllable element array. The serpentine-like aspect ratio also makes it possible to connect multiple discrete bulk resistors in parallel between address lines and select nodes for codeword demultiplexing.

Other geometries of bulk resistors of varying aspect ratios can also be achieved to match required width and height requirements. In accordance with an embodiment, the interleaved first and second set of patterned conductor protrusions can be arranged in a column or in a row. Also the second set of patterned conductor protrusions can be circumscribed or enclosed within the first set of patterned conductor protrusions.

Varying resistance values are achieved by varying the number of conductor protrusions. Reducing the number of conductor protrusions increases the resistance between the first and second sets of conductor protrusions. Increasing the number of conductive protrusions has the opposite effect of reducing the resistance between the first and second sets of conductive protrusions. Varying the number of conductive protrusions can be done by design in the metal mask. Also, options in the metal mask to facilitate laser severing of conductive protrusions away from the common node can achieve the same effect. Passing large currents through metal options to sever conductive protrusions is also contemplated in an alternate embodiment of the present invention.

Figure 3:
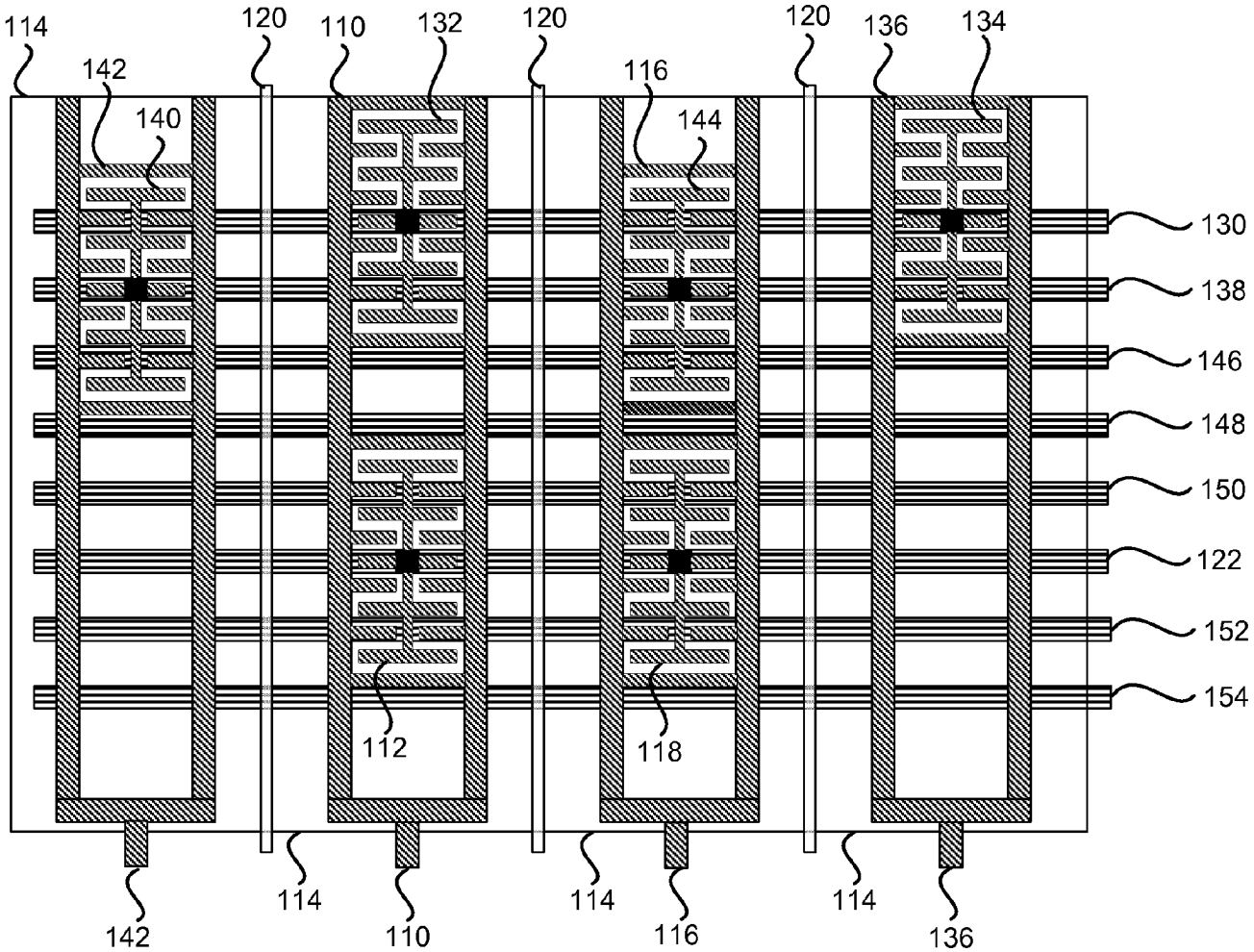
FIG. 3 is a top view of multiple adjacent address lines and multiple adjacent select lines in the codeword bulk resistor architecture in accordance with an embodiment.

FIG. 3 is a top view of multiple adjacent address lines and multiple adjacent select lines in the codeword bulk resistor architecture in accordance with an embodiment of the present invention. The bulk resistor film 114 covers the entire codeword area and may be disconnected or deactivated between address lines by longitudinal narrow strips 120 or laser cut paths. The first select line 122 is serially in electrical communication by a via 124 (see FIG. 1) to the enclosed conductor protrusions 112 through the bulk resistor film 114 to interleaved patterned conductor protrusions of the first address line 110. The first select line 122 is also serially in electrical communication by a via 124 to the enclosed conductor protrusions 118 through the bulk resistor film 114 to interleaved patterned conductor protrusions of the second address line 116.

A second select line 130 is serially in electrical communication by a via 124 to the enclosed conductor protrusions 132 through the bulk resistor film 114 to interleaved patterned conductor protrusions of the first address line 110. The second select line 130 is also serially in electrical communication by a via 124 to the enclosed conductor protrusions 134 through the bulk resistor film 114 to interleaved patterned conductor protrusions of a third address line 136. A third select line 138 is serially in electrical communication by a via 124 to the enclosed conductor protrusions 140 through the bulk resistor film 114 to interleaved patterned conductor protrusions of a fourth address line 142. The third select line 138 is also serially in electrical communication by a via 124 to the enclosed conductor protrusions 144 through the bulk resistor film 114 to interleaved patterned conductor protrusions of the second address line 116. The five select lines 146, 148, 150, and 152, and 154 in a larger perspective would be in electrical communication with at least two address lines each but in FIG. 3 are not programmed or coded to any of the shown address lines.

In yet another embodiment, the resistor for an address line comprises a first set of fingerlike conductors from the address line disposed adjacent to a bulk resistor film and a second set of fingerlike conductors adjacent the bulk resistor film being interleaved with the first set of fingerlike conductors. These interleaved first and second set of fingerlike conductors form a serpentine shape using the bulk resistor film. The second set of fingerlike conductor protrusions is electrically coupled by a contact to a select line.

The bulk resistor film may comprise at least one resistance metal oxide and at least one glass-based material or PEDOT or thick film resistor paste modified to have sufficiently high resistance. Alternatively, the bulk resistor film can contain Ruthenium dioxide ($RuO_2$), palladium and silver, or platinum and silver.

The first set of patterned conductor protrusions and the second set of patterned conductor protrusions are patterned to form a contiguous plurality of resistive paths between the first and second set of patterned conductor protrusions.

The bulk resistor is configured to connect an electrode in an array of electrically controllable elements (e.g. liquid-crystal control lines) to a signal line such as an address line. In accordance with an embodiment, the address lines have fingered traces formed adjacent to the bulk resistor film, where the fingered lines are configured to provide a plurality of impedances. Also a contact trace has fingered traces in proximity to the address line fingered traces. The serpentine shaped impedance is formed using the bulk resistor film between the address line fingered traces and the contact trace fingered traces. An ohmic contact is disposed on the contact trace and a select line is connected to the ohmic contact on one end and the other end of the select line is connected to the array of electrically controllable elements.

The products in which such bi-stable displays may work include retail applications, such as e-books, digital photo frames, and digital art. The use of the products may run from smaller monochrome reflective displays all the way up to large full color reflective displays.

An embodiment of one method for forming the bulk resistor comprises embossing an address line via having fingered traces in a resin. The fingered traces are configured to drive a plurality of impedances. A contact trace via having fingered traces in the resin is also embossed in proximity to the address line fingered traces. Additionally, metal is electroplated in the contact trace and address lines. A bump is electroplated adjacent the contact trace. Furthermore, a bulk resistor film is applied adjacent to the address lines and the contact trace to form a serpentine shaped impedance using the bulk resistor film between the address line fingered traces and the contact trace fingered traces. The contact trace can be plasma etched down to the manufacturing surface.

A dielectric or PEDOT (polyethylenedioxythiophene) is used to overcoat the codeword area and is etched to expose the contact bumps. A substrate is prepared with pre-pattered jumper lines. A conductive adhesive such as ACA (anisotropic conductive adhesive) is applied over the dielectric and the contact bumps to bond the substrate onto the contact bumps. The bulk resistors may also be laser patterned to divide the resistors.

Figure 4A:
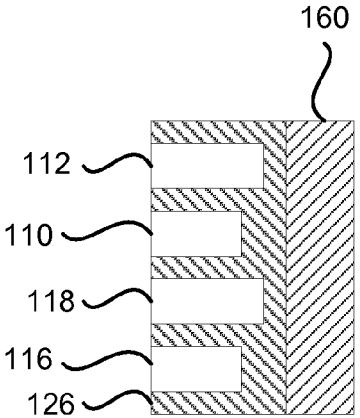
FIG. 4*a* is a cross-sectional view of an embossing step to build the resistor codeword architecture in accordance with an embodiment.

FIG. 4*a* is a cross-sectional view of an embossing step for embossing geometries onto a resin disposed on a conductive mandrel 160 in the codeword and display areas. This step embosses geometries for the address lines 110 and 116, and the serpentine metal traces 112 and 118 in the embossing resin 126 in the resistor codeword architecture in accordance with an embodiment.

Figure 4B:
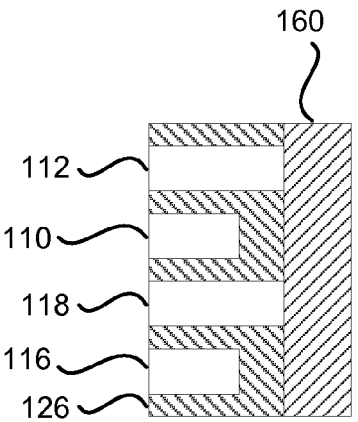
FIG. 4*b* is a cross-sectional view of an etching step to build the resistor codeword architecture in accordance with an embodiment.

FIG. 4*b* is a cross-sectional view of a plasma etching step to etch the serpentine metal trace geometries 112 and 118 down to the conductive mandrel 160 in the resistor codeword architecture in accordance with an embodiment.

Figure 4C:
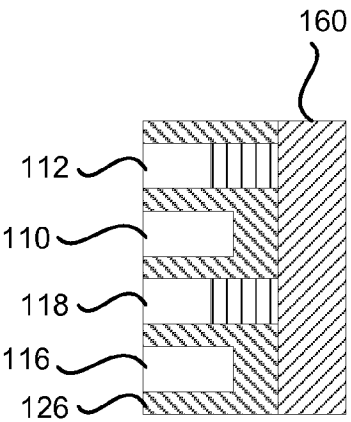
FIG. 4*c* is a cross-sectional view of a first electroplating step to build the resistor codeword architecture in accordance with an embodiment.

FIG. 4*c* is a cross-sectional view of a first nickel electroplating step which electroplates the serpentine metal traces 112 and 118 in the resistor codeword architecture in accordance with an embodiment.

Figure 4D:
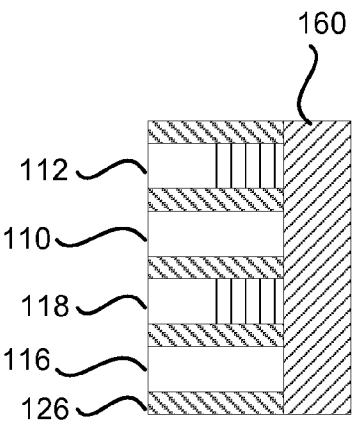
FIG. 4*d* is a cross-sectional view of a second etching step to build the resistor codeword architecture in accordance with an embodiment.

FIG. 4*d* is a cross-sectional view of a second plasma etching step to etch the address bus bars 110 and 116 down to the conductive mandrel 160 in the resistor codeword architecture.

Figure 4E:
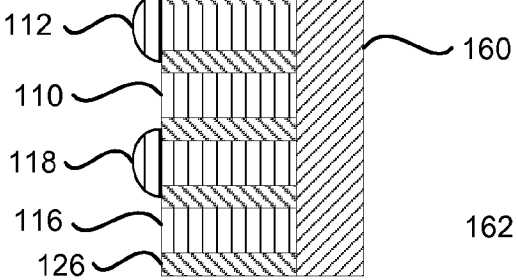
FIG. 4*e* is a cross-sectional view of a second electroplating step to build the resistor codeword architecture in accordance with an embodiment.

FIG. 4*e* is a cross-sectional view of a second nickel electroplating step to build the resistor codeword architecture. Nickel is electroplated in the cleared bus bar pattern and continues up the serpentine metal traces 112 and 118 into a bump. Optionally, a gold flash may be performed prior to the next process step to form a high quality ohmic contact surface.

Figure 4F:
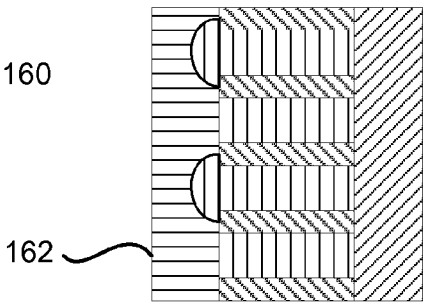
FIG. 4*f* is a cross-sectional view of a dielectric overcoating step to build the resistor codeword architecture in accordance with an embodiment.

FIG. 4*f* is a cross-sectional view of a dielectric overcoating step to overcoat the codeword area in the resistor codeword architecture with an overcoat 162. Depending on display construction, PEDOT may also be overcoated on the codeword area and then deactivated over the codeword area.

Figure 4G:
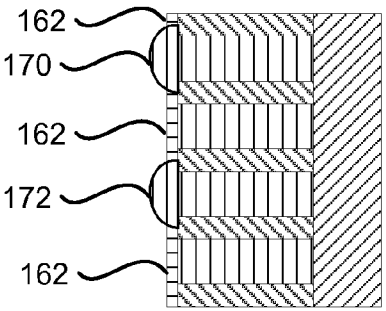
FIG. 4*g* is a cross-sectional view of a third etching step to build the resistor codeword architecture in accordance with an embodiment.

FIG. 4*g* is a cross-sectional view of a third plasma etching step etching the dielectric overcoat 162 in the resistor codeword architecture. This etching step over the codeword area exposes the via bumps 170 and 172.

Figure 4K:
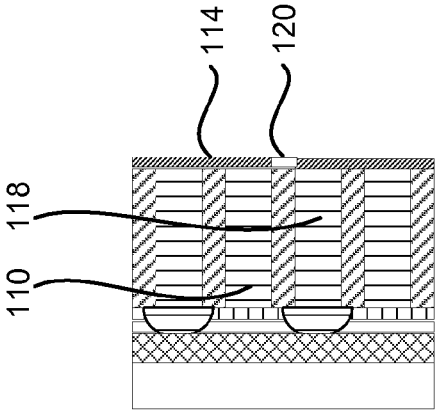
FIG. 4*k* is a cross-sectional view of a laser patterning step to build the resistor codeword architecture in accordance with an embodiment.
Figure 4J:
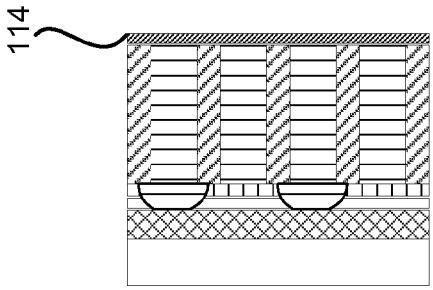
FIG. 4*j* is a cross-sectional view of a step removing the mandrel and disposing the bulk resistor coat to build the resistor codeword architecture in accordance with an embodiment.
Figure 4I:
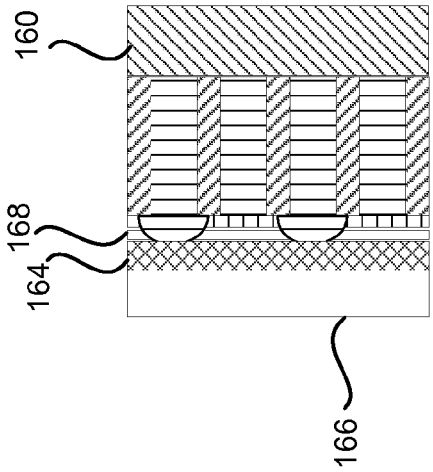
FIG. 4*i* is a cross-sectional view of a step bonding the substrate over the codeword area to build the resistor codeword architecture in accordance with an embodiment.
Figure 4H:
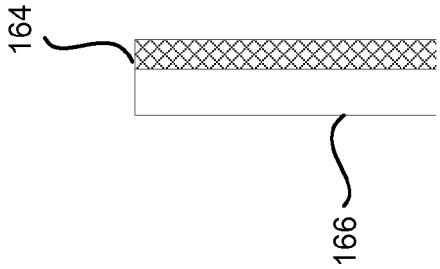
FIG. 4*h* is a cross-sectional view of a step preparing a substrate to build the resistor codeword architecture in accordance with an embodiment.

FIG. 4*h* is a cross-sectional view of a step preparing a substrate 166 in the process flow to build the resistor codeword architecture. The substrate is prepared by pre-patterning jumper lines 164 into the substrate 166 for the codeword area and the display.

FIG. 4*i* is a cross-sectional view of a step bonding the substrate 166 over the codeword area to build the resistor codeword architecture. Applying a blanket 168 of one of ACA and conductive adhesive over the codeword area and flipping the prepared substrate 166 onto the via bumps 170 and 172 (see FIG. 4*g*), and bonding the substrate 166 to the dielectric and also making electrical contact between the via bumps 170 and 172 with the pre-pattered jumper lines 164. Also in accordance with an embodiment of the present invention bonding can be done directly from gold to gold if the gold flashing is present.

FIG. 4*j* is a cross-sectional view of a step removing the mandrel 160 and disposing the bulk resistor coat 114 in the process flow to build the resistor codeword architecture. The conductive mandrel 160 is removed and a blanket of a bulk resistive compound 114 is deposited or printed over the codeword area on the mandrel side.

FIG. 4*k* is a perspective view of a laser patterning step to build the resistor codeword architecture. The bulk resistor film 114 can cover the area defined by the first address line 110 and the second address line 116 and may be disconnected by laser or deactivated between the first address line 110 and the second serpentine metal trace 118 by defining a narrow longitudinal strip 120.

The invention claimed is:

1. A resistor, comprising:

a bulk resistor film;

a first set of patterned conductor protrusions, disposed adjacent the bulk resistor film; and a second set of patterned conductor protrusions disposed adjacent the bulk resistor film and interleaved with the first set of conductor protrusions to provide a plurality of resistive paths to the first set of patterned conductor protrusions through the bulk resistor film.

2. A resistor as in claim 1, wherein space between the first set of patterned conductor protrusions and the second set of patterned conductor protrusions forms a serpentine-like shape disposed adjacent the bulk resistor film.

3. The resistor of claim 1, further comprising the interleaved first and second set of patterned conductor protrusions arranged in a column.

4. The resistor of claim 1, wherein the second set of patterned conductor protrusions is circumscribed within the first set of patterned conductor protrusions.

5. The resistor of claim 1, further comprising a reduced number of conductor protrusions to increase resistance between the first and second sets of conductor protrusions.

6. The resistor of claim 1, further comprising an increased number of conductor protrusions to decrease resistance between the first and second sets of conductor protrusions.

7. The resistor of claim 1, wherein the first set of conductor protrusions is an address line disposed adjacent the bulk resistor film.

8. The resistor of claim 1, further comprising a contact electrically coupled to the second set of connected conductor protrusions, the contact being in electrical communication with a select line.

9. A resistor for an address line, comprising:

a first set of fingerlike conductors from the address line disposed adjacent to a bulk resistor film;

a second set of fingerlike conductors adjacent the bulk resistor film being interleaved with the first set of fingerlike conductors, wherein the interleaved first and second set of fingerlike conductors form a serpentine shape using the bulk resistor film; and a contact electrically coupled to the second set of fingerlike conductor protrusions and a select line.

10. The resistor of claim 9, wherein the interleaved first and second set of fingerlike conductors are arranged in a column or row.

11. The resistor of claim 9, further comprising a reduced number of fingerlike conductors to increase resistance between the first and second sets of conductive fingers.

12. The resistor of claim 9, wherein the second set of fingerlike conductor protrusions are circumscribed within the first set of fingerlike conductor protrusions.

13. The resistor of claim 9, wherein the bulk resistor film comprises at least one resistance metal oxide and at least one glass-based material or PEDOT or thick film resistor paste modified to have sufficiently high resistance.

14. The resistor of claim 13, wherein the bulk resistor film contains Ruthenium dioxide ($RuO_2$), palladium and silver, or platinum and silver.

15. The resistor of claim 9, wherein the first set of patterned conductor protrusions and the second set of patterned conductor protrusions are patterned to form a plurality of resistive paths between the first and second set of patterned conductor protrusions.

16. A resistor configured to connect an electrode in an array of electrically controllable elements to a decoded signal, comprising:

a planar bulk resistor film;

an address line having fingered traces formed adjacent to the bulk resistor film, the fingered lines being configured to connect a plurality of impedances;

a contact trace having fingered traces in proximity to the address line fingered traces;

a serpentine shaped impedance formed using the bulk resistor film between the address line fingered traces and the contact trace fingered traces;

an ohmic contact disposed on the contact trace; and a select line having a first end connected to the ohmic contact and a second end connected to the array of electrically controllable elements.

17. A resistor as in claim 16, wherein the fingered lines are configured to connect a plurality of discrete resistors in a voltage divider circuit between the decoded signal and an electrically controllable element.

18. A method for forming a resistor, comprising:

embossing an address line via having fingered traces in a resin, the fingered traces being configured to drive a plurality of impedances;

embossing a contact trace via having fingered traces in the resin in proximity to the address line fingered traces;

electroplating metal in the contact trace and address lines;

building up a contact bump on top of the contact trace; and applying a bulk resistor film adjacent to the address lines and contact trace to form a serpentine shaped impedance using the bulk resistor film between the address line fingered traces and the contact trace fingered traces.

19. A method as in claim 18, laser patterning the bulk resistor film so as to divide resistors.

20. A method as in claim 18, plasma etching the contact trace down to the manufacturing surface.

21. A method as in claim 18, further comprising, overcoating a codeword area with a dielectric; etching the dielectric to expose the contact bumps; applying a conductive adhesive over the dielectric and the contact bumps; and bonding a substrate having pre-patterned lines onto the contact bumps.

* * * * *